United States Patent [19]

Granbom

[11] Patent Number: 4,881,454

[45] Date of Patent: Nov. 21, 1989

[54] PRESSURE FLUID CYLINDER DEVICE

[76] Inventor: Bo Granbom, 13 Lostigen, S-731 42 Köping, Sweden

[21] Appl. No.: 231,658

[22] Filed: Aug. 12, 1988

Related U.S. Application Data

[63] Continuation of Ser. No. 881,716, Jul. 3, 1986, abandoned.

[51] Int. Cl.[4] ..... F01B 29/08

[52] U.S. Cl. ..... 92/88; 92/169.1

[58] Field of Search ..... 92/88, 137, 169.1, DIG. 1

[56] References Cited

U.S. PATENT DOCUMENTS

| | | | |
|---|---|---|---|
| 2,373,455 | 4/1945 | Carey | 92/88 X |
| 4,164,893 | 8/1979 | Granbom et al. | 92/88 |
| 4,252,285 | 2/1981 | Hammond et al. | 92/88 |
| 4,373,427 | 2/1983 | Garlapaty et al. | 92/88 |

FOREIGN PATENT DOCUMENTS

| | | |
|---|---|---|
| 0082829 | 6/1983 | European Pat. Off. . |
| 3124878 | 12/1982 | Fed. Rep. of Germany . |

*Primary Examiner*—Robert E. Garrett
*Assistant Examiner*—Mark A. Williamson
*Attorney, Agent, or Firm*—Cushman, Darby & Cushman

[57] ABSTRACT

An improved pressure fluid cylinder of the type comprising a cylinder having a longitudinal slot through which a carrier element protrudes, the carrier element being connected to a piston which is movable in the cylinder. The slot is sealed by a sealing band and the piston is provided with a sealing cuff at each end. According to the invention the slot has a width which is greater on the outside of the cylinder than on the inside thereof.

1 Claim, 2 Drawing Sheets

PRESSURE FLUID CYLINDER DEVICE

This is a continuation of application Serial No. 881,716, filed July 3, 1986 which was abandoned upon the filing hereof.

BACKGROUND OF THE INVENTION

Pressure fluid cylinders of the type concerned in US patent 4 164 893 and comprising a cylinder having a longitudinal slot through which a carrier means arranged in a piston, which is movable in the cylinder, extends, the slot being sealed by means of a sealing band and the piston being provided with a sealing cuff at each end, are beset with the shortcoming that the thickness of the carrier means is limited by the width or breadth of the slot. It is desired to make the carrier means broader in order that it might absorb greater lateral loads. However, it is not possible with the present embodiment of the cylinder to widen the slot without being obliged to make the sealing band broader. A broader sealing band brings a greater internal ovality with a greater difficulty in managing the axial seal of the sealing cuffs of the piston and the ends of the cylinder and a risk of deformation or outward bending at overpressure in the cylinder.

SUMMARY OF THE INVENTION

It is possible by means of the present invention set forth in the characterizing portions of the claims to make the carrier means broader without the corresponding claims on an increase of the width of the sealing band.

BRIEF DESCRIPTION OF THE DRAWINGS

The invention will be described in greater detail in the form of an example with reference to the drawing in which.

DETAILED DESCRIPTION OF THE PREFERRED EMBODIMENT

Figure 1:
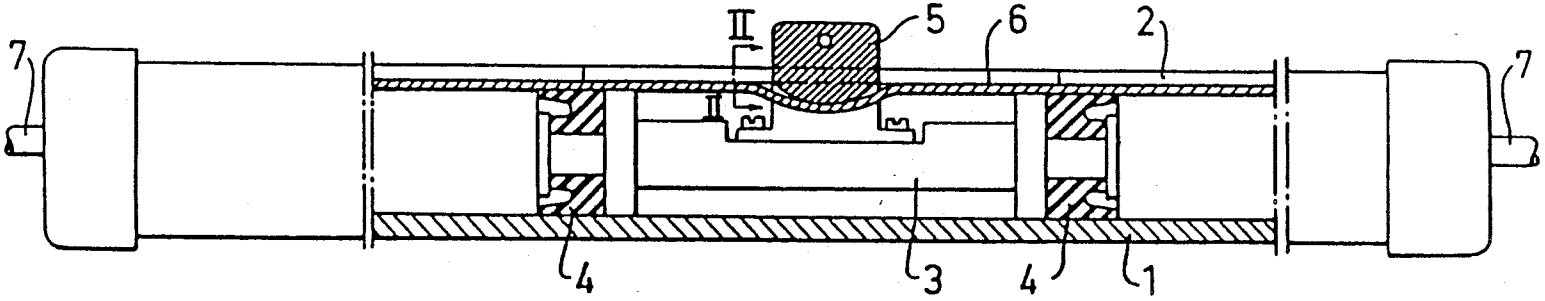
FIG.1 (PRIOR ART)
FIG. 1 shows schematically a prior art pressure fluid cylinder of the type to which the invention pertains.

The pressure fluid cylinder consists in known manner of a cylinder 1 along the whole of which a slot 2 is provided. The piston 3 is provided with sealing cuffs 4 in each end and a carrier means 5 extending through the slot 2 and arranged to be connected to the apparatus served by or serving the cylinder. The slot 2 in the cylinder is also in known manner sealed by an interior sealing band 6 extending through the piston 3 in such a way that the attachment of the carrier means 5 to the piston 3 is made possible. The band 6 is maintained against the cylinder wall by the aid of magnets 9 (see FIG. 2) arranged on the outside of the cylinder and along the slot. The cylinder 1 is connected at its ends to supply and outlet lines 7 for pressure fluid.

Figure 2:
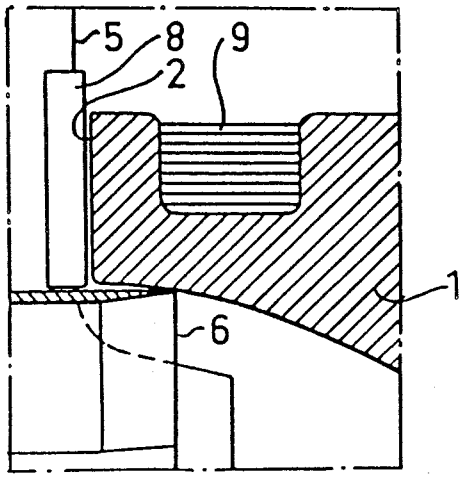
FIG. 2 (PRIOR ART)
FIG. 2, is an expanded scale, fragmentary transverse cross-sectional view, corresponding to the right half of FIG. 3, showing a prior art device, and taken on line II—II of FIG. 1.

What has been described above concerns the general build-up of the pressure fluid cylinder and slide bars 8 are also shown in FIG. 2 which are arranged on the carrier means 5 and intended to slide along the edges of the slot 11.

As is apparent from the right part of FIG. 2 a widening of the slot 2 will also involve a corresponding widening of the band 6. This means, in turn, that a greater part of the inside of the cylinder will not be round which makes it difficult to obtain a perfect sealing at the sealing cuffs 4 and the ends of the cylinder. Thus, it is beset with great disadvantages to widen the slot at this known type of cylinder in order to make the carrier means 5 more resistant to outward lateral bending. Due to the limited width of the slot 2 the adaptation of the slide bars 8 will further influence the bending stiffness of the carrier means 5 which should appear clearly from FIG. 2.

Figure 3:
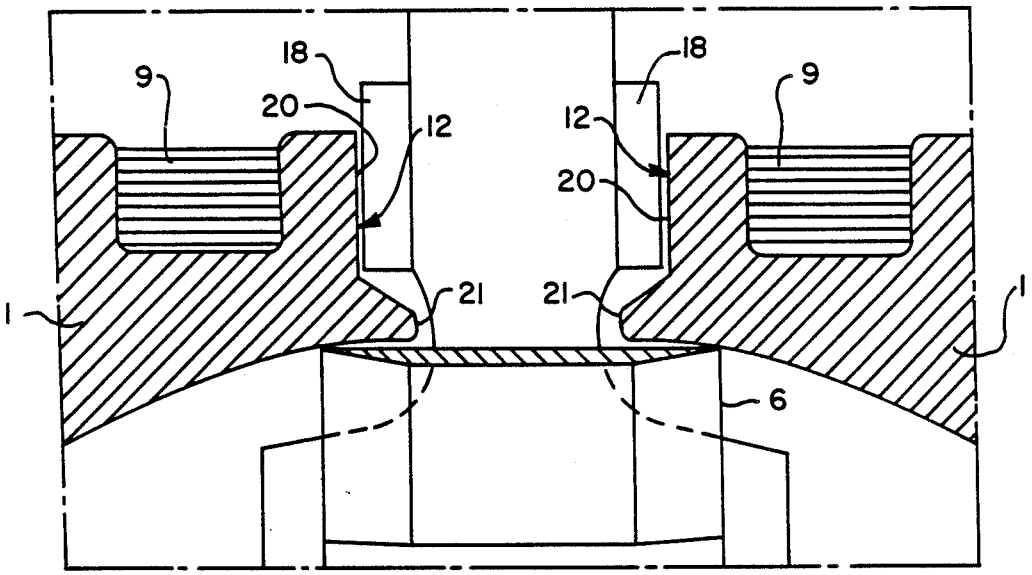
FIG. 3 is an expanded scale, fragmentary transverse cross-sectional view of a device of the invention.

According to the invention, apparent from FIG. 3 the respective side of the slot 12 is divided into a first plane limiting side 20 and a second limiting side 21 which lies more closely to the centre of the slot relative to the first limiting side 20. In this example, the second limiting side 21 is shown to be plane and parallel to the first limiting side 20.

By the embodiment, it is possible to maintain the width of the interior sealing band 6 simultaneously as the slot is made wider at the top. This makes it possible to form the carrier means 5 with a greater thickness than what has been possible before with maintained function of the cylinder which, in turn, means that the bending resistance of the carrier means 5 can be essentially increased. As the slide bar 18 will coact in practice with the limiting side 20 of the slot more closely to the outside of the cylinder than what is the case in the example shown in FIG. 2, the lateral stability of the carrier means 5 will increase. In the example shown in FIG. 3, the slide bar 18 is arranged, unrecessed on the carrier means 5.

By maintaining the interior part of the slot 12 as narrow as possible, the sealing band 6 will also have enough support at containing interior overloads which will not be the case with a wider slot.

Of course it is not necessary that the limiting side 21 is plane but it can of course be rounded. Moreover, the embodiment shown in FIG. 3 will be optimal as to the guide of the carrier means 5, but of course it is possible to form the side of the slot continuously inclined inwards towards the centre of the slot.

What I claim is:

1. A fluid pressure cylinder, comprising: wall means defining an axially extending cylinder having an axial bore having two opposite ends, said wall means including an inner peripheral surface; said cylinder further including two axially-opposite end walls and means for admitting fluid pressure to and relieving fluid pressure from said axial bore near each of said opposite ends;

means defining an axially-extending slot through said cylinder, said slot communicating with said axial bore; said slot including a laterally wider radially outer portion and a laterally narrower radially inner portion, each having two laterally spaced opposite edges;

a flexible band received in said axial bore and extending axially therealong bridging said slot;

means normally urging opposite lateral margins of a radially outer face of said flexible band into sealing engagement with said inner peripheral surface of said cylinder on respectively opposite sides of said slot;

a piston having two axially opposite ends, each including a respective sealing cuff; said piston being axially slidingly received in said axial bore with said sealing cuffs thereof disposed in circumferential sealing engagement, at two respective axially-spaced locations, with a composite of said inner peripheral surface and a radially inner face of said flexible band;

an axially slidable carrier, said carrier having:

a laterally wider portion disposed in said laterally wider portion of said slot and located so as to be accessible from externally of said cylinder, a laterally narrower portion extending radially inwardly from said laterally wider portion of said carrier, into said axial bore, and a further portion extending part-way around said flexible band and connecting with said piston at a site located axially between said sealing cuffs, said further portion including means for locally distending said flexible band away from sealingly bridging a radially inner end of said slot, whereby as said carrier and said piston are moved together axially of said cylinder, a site where said flexible band is locally distended correspondingly axially moves along the radially distended correspondingly axially moves along the radially inner end of said slot while remaining located axially between said sealing cuffs of said piston; and said carrier further includes means located on said laterally wider portion thereof for securing other structure to said carrier so that said carrier may be used for moving such other structure or such other structure may be used for moving said carrier axially along said slot;

said laterally wider portion of said carrier being laterally wider than said laterally narrower portion of said slot; and said carrier, in said laterally wider portion thereof, including slide means disposed in sliding engagement with both said edges of said laterally wider portion of said slot.

* * * * *